US006744696B2

(12) United States Patent
Vernay et al.

(10) Patent No.: US 6,744,696 B2
(45) Date of Patent: Jun. 1, 2004

(54) ANNUAL DATE MECHANISM FOR CLOCK MOVEMENT

(75) Inventors: Frank Vernay, Geneve (CH); Pierre-Alain Graemiger, Trelex (CH)

(73) Assignee: Rolex S.A.

( * ) Notice: Subject to any disclaimer, the term of this patent is extended or adjusted under 35 U.S.C. 154(b) by 0 days.

(21) Appl. No.: 10/360,132

(22) Filed: Feb. 6, 2003

(65) Prior Publication Data

US 2003/0151981 A1 Aug. 14, 2003

(30) Foreign Application Priority Data

Feb. 11, 2002 (EP) ..... 02405094

(51) Int. Cl.[7] ..... G04B 19/20; G04B 19/24
(52) U.S. Cl. ..... 368/37; 368/28; 368/35
(58) Field of Search ..... 368/28–29, 31–40

(56) References Cited

U.S. PATENT DOCUMENTS 3,673,789 A 7/1972 Tsuzuki et al.
3,735,583 A * 5/1973 Bachmann ..... 368/194
3,750,385 A * 8/1973 Kocher ..... 368/35
3,841,084 A * 10/1974 Eumier ..... 368/37
5,432,759 A * 7/1995 Vaucher ..... 368/28
5,699,321 A * 12/1997 Vaucher ..... 368/37
6,108,278 A * 8/2000 Rochat ..... 368/28
2001/0046187 A1 * 11/2001 Graemiger ..... 368/190

FOREIGN PATENT DOCUMENTS

DE 205445 1/1909

* cited by examiner

*Primary Examiner*—David Martin
*Assistant Examiner*—Michael L. Lindinger
(74) *Attorney, Agent, or Firm*—Sturm & Fix LLP

(57) ABSTRACT

This annual date mechanism comprises a correction cam (1*a*) in kinematic connection with a date indicating runner (1), a correction rocker (8) engaged on the one hand with said correction cam (1*a*) and, on the other hand, with an annual cam (18). A spring (9) presses the correction rocker (8) against the cams (1*a*, 18). The correction cam (1*a*) comprises a portion (1*a*') for arming said spring (9), followed by a portion (1*a) sized to cause said date runner (1) to move by one step between "31" and "1", under the pressure of said spring (9**).

6 Claims, 6 Drawing Sheets

ANNUAL DATE MECHANISM FOR CLOCK MOVEMENT

CROSS REFERENCE TO THE RELATED APPLICATIONS

This application claims priority of European Application No. 02405094.0 filed Feb. 11, 2002, entitled Annual Date Mechanism for Clock Movement.

BACKGROUND OF THE INVENTION

1. Field of the Invention

The present invention relates to an annual date mechanism for a clock movement comprising a date indicating runner with thirty-one positions engaged once a day with a drive runner in kinematic connection with the geartrain of said clock movement, an annual cam, the contour of which is shaped to distinguish the thirty-one-day months from the other months, means for driving this cam by one revolution per year and a correction mechanism connected to said annual cam to advance said indicating runner by one additional position at the end of each month of less than 31 days.

This type of date mechanism which is a compromise between the simple date and the perpetual or semi-perpetual date involving a relatively complicated and therefore tricky mechanism made up of a fairly large number of parts, occupying a great deal of space both in the plane and in terms of height, has long been proposed. The simple date mechanism entails resetting the date five times per year, at the end of the months containing less than 31 days. The annual date requires just one correction, at the end of the month of February.

2. Description of the Related Art

Among date mechanisms of this type, mention may be made of CH 583 932, CH 684 815, CH 685 585, EP 756 217, CH 581 341 and EP 987 609. All these mechanisms have a trailing date change, furthermore, the passage between "30" and "1" takes place through a two-phase jump thus causing "31" to appear for some length of time between the "30" and the "1" at the end of months of under 31 days. Furthermore, some of the aforementioned mechanisms are relatively complicated. Date mechanisms with instantaneous jump are also known, but these are simple dates.

BREIF SUMMARY OF THE INVENTION

The object of the present invention is to render annual a simple date mechanism, preferably instantaneous, using a solution which adds as few additional parts as possible, thus guaranteeing reliable operation and small bulk.

To this end, the subject of the present invention is a date mechanism of the aforementioned type, as defined by claim 1.

The main advantages of this mechanism lie in its simplicity and in its efficiency and its reliability. Advantageously, this mechanism may be associated with an instantaneous jump date mechanism and allows automatic correction at the end of months of under 31 days in a way which is also instantaneous.

Particular features and specific advantages will become apparent through the description which will follow, and with the aid of the accompanying attached drawings which, schematically and by way of example, illustrate one form of embodiment and one alternative form of the date mechanism that is the subject of the present invention.

DETAILED DESCRITPTION OF THE INVENTION

Figure 1:
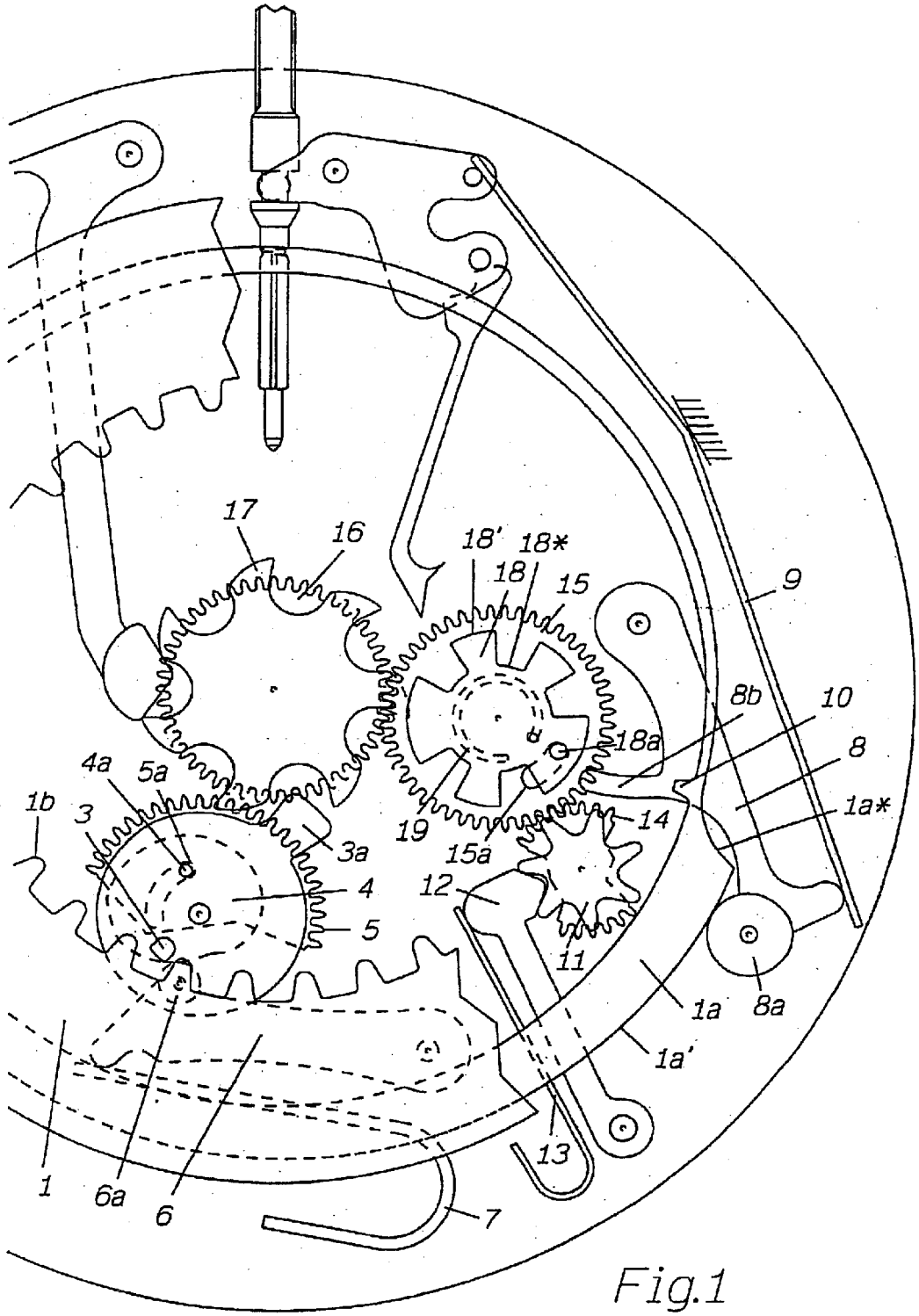
FIG. 1 is a plan view of this mechanism in a first position corresponding to August 30.
Figure 2:
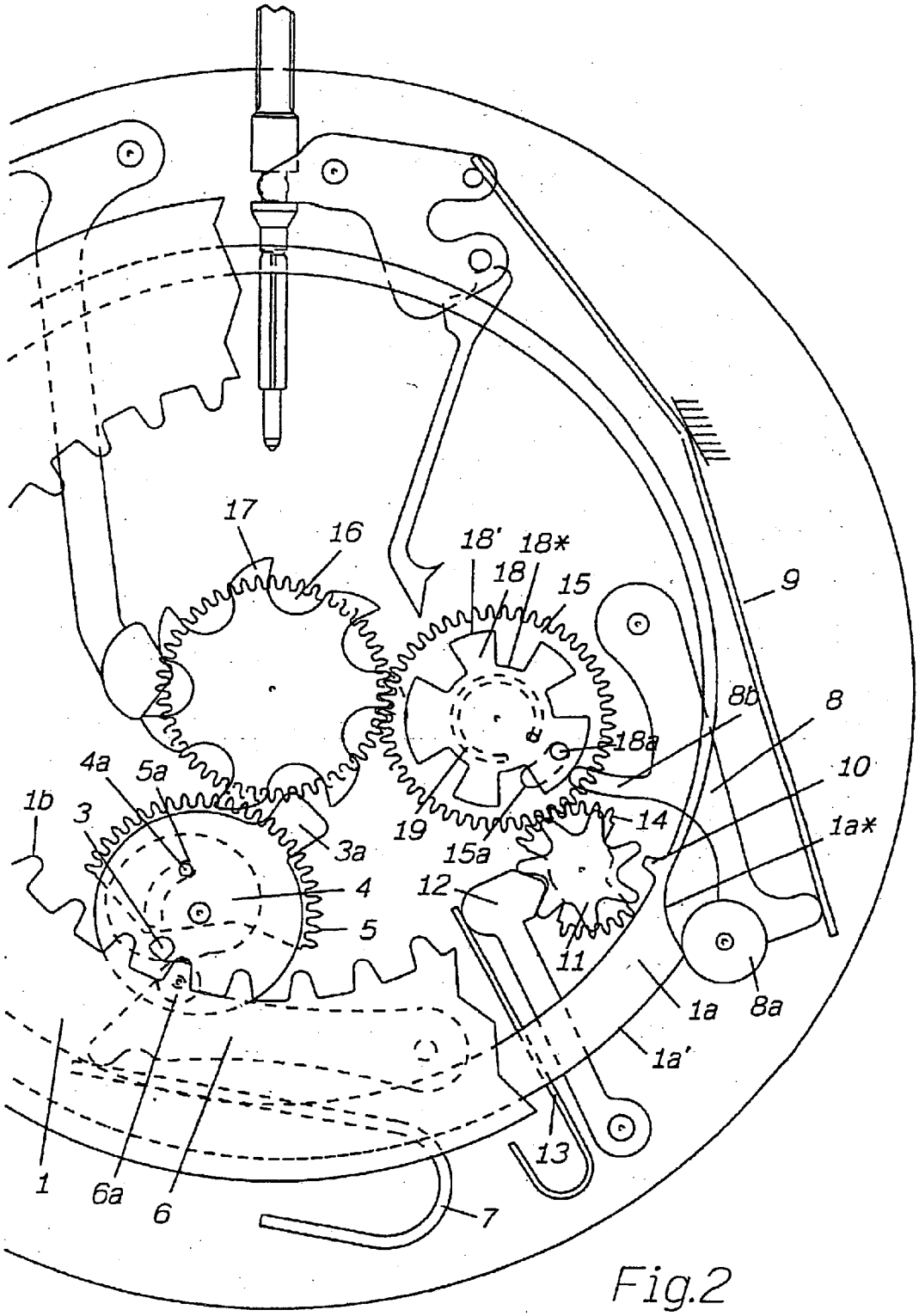
FIG. 2 is a plan view of this mechanism in the position it occupies on August 31.

The date mechanism illustrated by FIGS. 1 to 5 comprises an annular runner 1 bearing the dates from 1 to 31. This annular runner 1, more generally known as the date disk, has the customary internal set of teeth 1*b* and is secured to an annular correction cam 1*a*.

The set of teeth 1*b* is engaged, on the one hand, with a position jumper 2 (FIG. 6) and, on the other hand, with a driving finger 3 secured to an instantaneous jump cam 4 concentric with a driving wheel 5. An opening in the shape of a circular arc 5*a* secured to the driving wheel 5 and a pin 4*a* secured to the instantaneous jump cam 4 serve to secure this cam to the driving wheel but also allow a certain angular play the purpose of which will be explained later on. A roller 6*a* of a rocker 6 for the instantaneous changing of the date is pressed against the periphery of the instantaneous jump cam 4 by a spring 7.

In this embodiment, a second finger 3*a* is intended to drive a seven-branched days-of-the-week star 17 once per day at the same time as the date disk 1. However, the invention is not restricted to the presence of this day star 17, it being possible for the mechanism according to the invention to indicate only the date.

The mechanism which has just been described is that of a simple instantaneous date mechanism. We are now going to describe that part of the mechanism which allows the switch from a simple date mechanism to an annual date mechanism, while at the same time remaining instantaneous, at least essentially, that is to say from the 1st to the 30th of the month. As mentioned beforehand, the date disk is secured to an annular correction cam 1*a* against which a correction rocker 8 equipped with a roller 8*a* is pressed by a spring 9. This correction cam 1*a* comprises a long circular ramp 1*a*' intended to arm the spring 9 of the correction rocker. This annular ramp 1*a*' extends over an angle of almost 348° (30/31st), gradually diverging from the center of rotation of the date disk and ending in a concave curve 1*a which connects the end to the start of the long circular ramp and which extends over almost 12°. This concave curve 1*a allows the rocker 8 pressed by the spring 9 to advance the date disk by one step using the energy stored up in the spring 9. Note that the shape of the concave curve 1*a connecting the two ends of the circular ramp 1***a*' is not essential to the operation of the automatic correction mechanism and could be replaced by a simple rectilinear ramp.

Facing the junction between the concave curve 1*a and the start of the circular ramp 1***a*', the internal edge of the correction cam 1*a* bears a tooth, a finger or a projection 10, intended to engage, upon each rotation of the date disk 1, with a correction star 11 in engagement with a positioning jumper 12 pressed by a spring 13.

This correction star 11 is secured to an intermediate wheel 14 meshing with an intermediate wheel 15 itself engaged with a month indicating runner 16 concentric with the day star 17. A circular annual cam 18 is concentric with the intermediate wheel 15. It has a pin 18*a* engaged with an opening in the shape of a circular arc 15*a* belonging to the intermediate wheel 15. A spring 19, one end of which is secured to the intermediate wheel 15 and the other end of which is secured to the circular annual cam 18 tends to hold the pin 18*a* against the left end of the opening 15*a*. The circular annual cam 18 is divided angularly into twelve equal sectors, each sector corresponding to one month of the year. The 31-day months correspond to the large-diameter parts 18' of the cam 18, while the five months of under 30 days correspond to the small-diameter parts 18* thus forming five recesses in the large-diameter part 18' of the annual cam 18.

Figure 3:
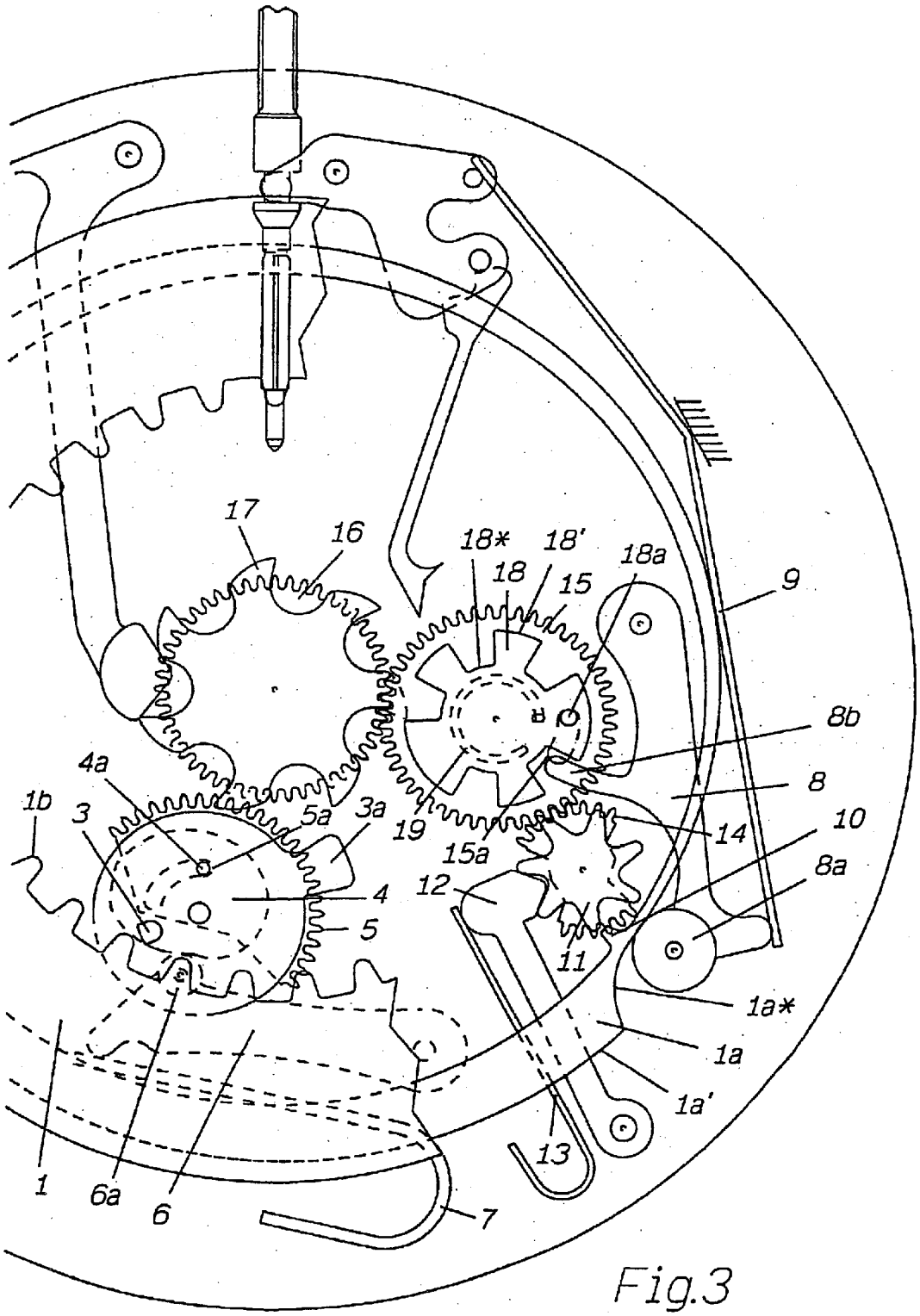
FIG. 3 is a plan view of this mechanism in the position it occupies on September 1.

The correction rocker 8 has a finger 8*b* which is intended to collaborate with the annual cam 18 at the end of each month as will now be explained. As can be seen in FIG. 1 which corresponds to August 30, the roller 8*a* of the correction rocker 8 arrives near the end of the circular ramp 1*a*' of the cam 1*a*. The finger 8*b* of the correction rocker 8 finds itself facing a large-diameter part 18' of the annual cam 18. On moving from the 30th to the 31st (FIG. 2), it can be seen that the roller 8*a* of the correction rocker 8 has overshot the end of the circular ramp 1*a*' of the correction cam 1*a* but the large-diameter part 18' of the annual cam 18 which lies facing the finger 8*b* prevents the rocker 8 from descending along the concave curve 1*a of the correction cam 1***a*. As a result, the move from August 31 to September 1 occurs normally, with the aid of the driving finger 3 secured to the instantaneous jump cam 4, as can be seen in FIG. 3.

During this switch from the 31st to the 1st of the next month, the roller 8*a* of the correction cam 8 has moved from the end to the start of the circular ramp 1*a*' of the correction cam 1*a*. At the same time, the finger 10 of this correction cam 1*a* drives the correction star 11 by one step. Given that the intermediate wheel 14 is secured to the correction star 11, the intermediate wheel 15 and the month indicating runner 16 are driven simultaneously with the correction star 11. This rotation allows the finger 8*b* of the correction rocker 8 to insert itself between two large-diameter parts 18' of the correction cam 18, corresponding to a month of under 31 days, in this instance, the month of September. As with each change of date, the finger 3*a* causes the day star 17 to turn.

Figure 4:
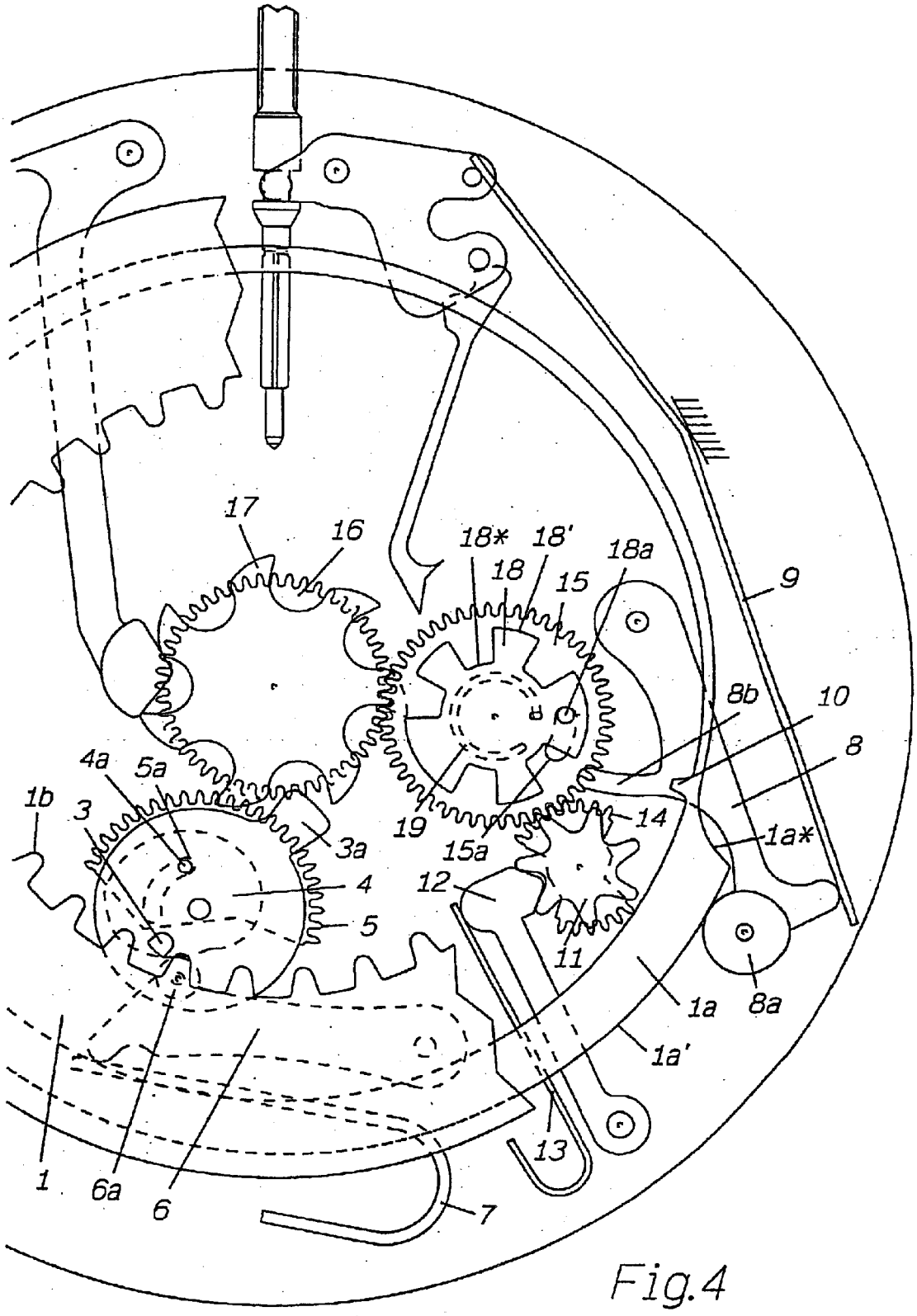
FIG. 4 is a plan view of this mechanism in the position it occupies on September 30.
Figure 5:
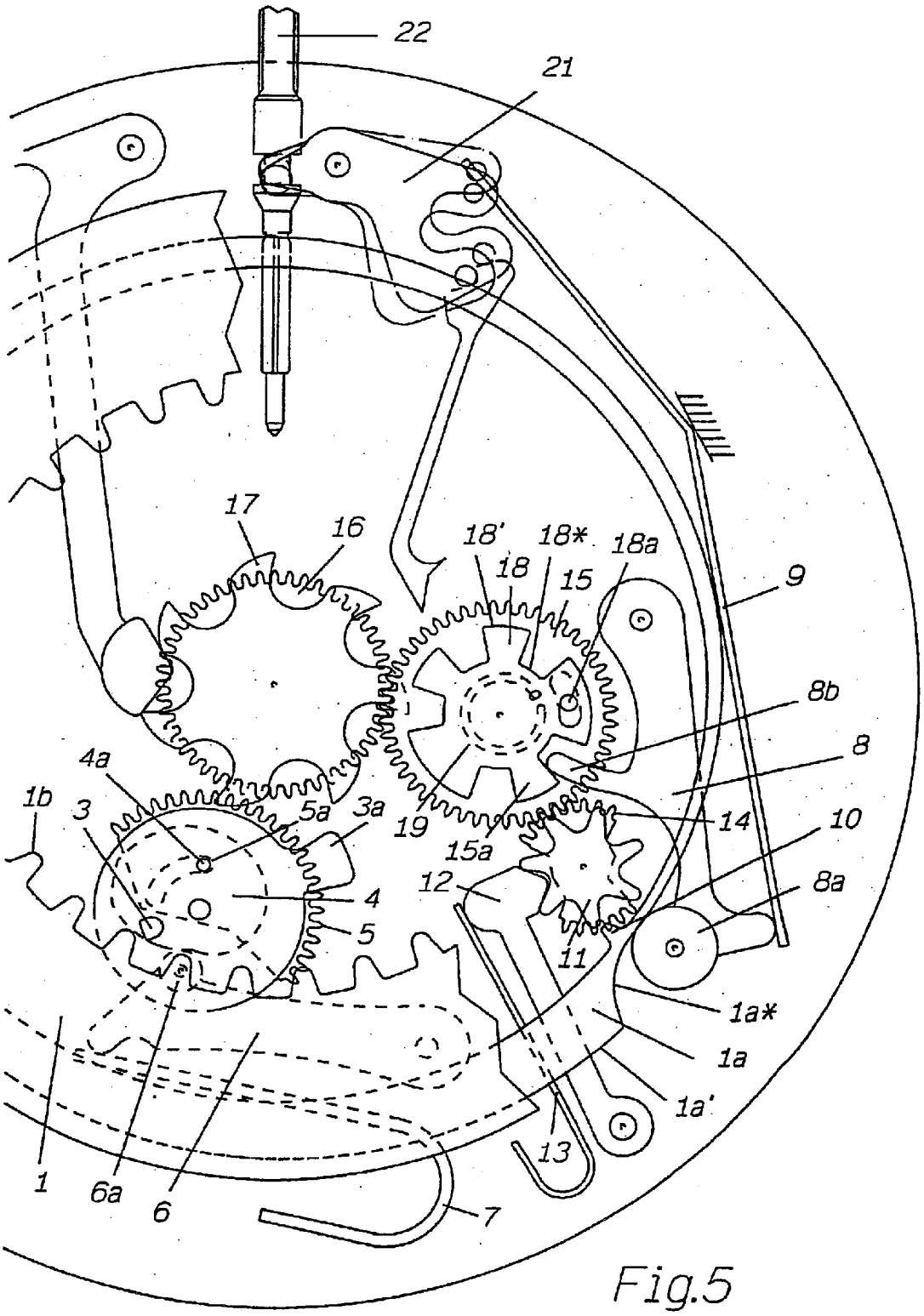
FIG. 5 is a plan view of this mechanism in the position it occupies on October 1; at the same time, this figure also shows the mechanism in the position for the manual correction of the date.

FIGS. 4 and 5 show the passage from September 30 to October 1. In FIG. 4, the correction rocker 8 and the correction cam occupy the same position as in FIG. 1, but the annual cam 18 is arranged in such a way that a recess situated between two large-diameter parts 18' lies facing the finger 8*b* of the correction rocker. In consequence, the next time the date disk 1 is driven, at midnight on September 30, the finger 3 moves the date disk by one step normally, thus bringing the roller 8*a* of the correction rocker into the position illustrated by FIG. 2, but given that the finger 8*b* of the correction rocker 8 lies facing a small-diameter part 18* of the annual cam 18, the spring 9 pushes this correction rocker 8 and its finger 8*b* into the recess of the annual cam 18, so that during this rocking which takes place under the pressure of the spring 9, the roller 8*a* slides along the concave curve 1*a of the correction cam 1***a* which moves the date disk 1 by a second step to cause it to display October 1.

During this second step, which immediately follows the first step of the date disk 1, the correction star 11 is moved by a step at the same time as the intermediate wheels 14 and 15 and the month runner 16. Given that the finger 8*b* of the correction rocker 8 is engaged in a recess of the annual cam 18, the latter cannot turn. This is why the annual cam 18 remains stationary and the opening in the shape of an arc of a circle 15*a* formed in the intermediate wheel 15 allows a relative angular movement between this intermediate wheel 15 and the annual cam 18. During the next month, the correction rocker 8 is gradually lifted by the circular ramp 1*a*' of the correction cam 1*a*. Once the finger 8*b* of this rocker has completely left the recess in the annual cam 18, the spring 19 returns the pin 18*a* of the annual cam 18 into abutment against the other end of the opening in the shape of a circular arc 15*a* belonging to the intermediate wheel 15, so that the end of the finger 18*b* of the rocker 8 then finds itself back facing a large-diameter part 18' of the annual cam 18, placing it out of action on October 31 as explained hereinabove in respect of the passage from August 30 to 31.

In the example described hereinabove, during the passage of the date disk from the 31st to the 1st of the next month, the finger 8*b* of the rocker 8 drops into a recess 18* of the annual cam 18. Depending on the pressure exerted by the spring 9 of the correction rocker 8, the friction between the finger 8*b* of the rocker 8 and the part 18' of the annual cam may be higher than the couple developed by the spring 19, which means that instead of dropping straight away into the recess 18* of the annual cam 18, the finger 8*b* will remain on the large-diameter part 18' of the cam 18 while the intermediate wheel 15 is driven by the finger 10, the star 11 and the intermediate wheel 14, thus arming the spring 19. As soon as the ramp 1*a*' of the correction cam 1*a* has raised the rocker 8 sufficiently during the course of the next month, the annual cam 18 will be moved angularly by one step in the clockwise direction by the relaxation of the spring 19 so that the finger 8*b* of the rocker 8 will then drop into a recess 18* of the annual cam 18, corresponding to a month of under 31 days.

In the embodiment of the instantaneous date mechanism described hereinabove, the opening 5*a* made in the driving wheel 5 for the date mechanism, in which opening the pin 4*a* of the instantaneous jump cam 4 is engaged, allows relative angular displacement of one step between this cam 4 and the driving wheel 5, in kinematic connection with the timepiece indicator geartrain, so as to allow the instantaneous jumping of the date disk 1. After the jump of this date disk, the driving finger 3 secured to the instantaneous jump cam 4 finds itself between two teeth of the set of teeth 1*b* and since the pin 4*a* of the cam 4 is moved during the jump to the other end of the opening in the shape of a circular arc 5*a* belonging to the driving wheel 5, it guarantees that the date disk 1 cannot jump by more than one step, the driving finger 3 thus acting as a locking member.

The annual date mechanism, in this version, will be instantaneous, but the passage from the 30th to the 1st, in the case of a 30-day month, will take place in two stages, 31 being displayed for a certain period of time until the driving wheel has advanced and caused the finger 3 to leave the set of teeth 1*b* of the date disk 1.

Figure 6:
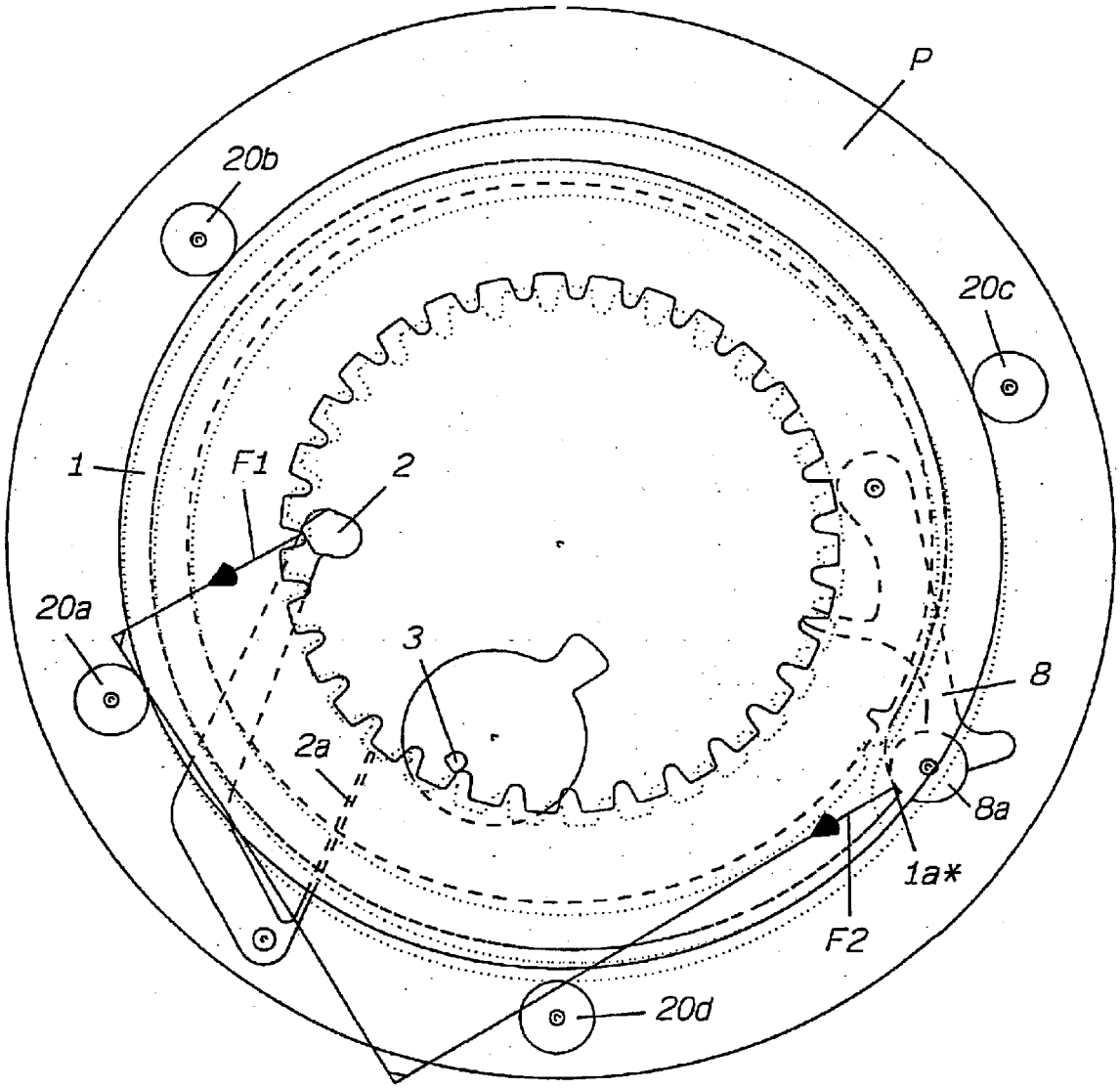
FIG. 6 is a plan view of an alternative form of the guidance of the date disk.

FIG. 6 illustrates an alternative form which makes it possible to avoid this two-stage passage from the 30th to the 1st. For this, the date disk 1 is mounted so that it can pivot on three guide rollers 20*a*, 20*b*, 20*c* mounted so that they can pivot on the mounting plate P bearing the calendar mechanism, on each side of the end of the positioning jumper 2 of the date disk 1 which is in contact with the set of teeth 1*b* of this disk 1, so that this jumper 2, pressed by a spring 2*a* formed by an elastic arm formed integrally with it, presses this date disk 1 against these guide rollers 20, guiding it about a virtual axis that coincides with the center of this date disk 1. An arrow $F_1$ has been used to show the moment of the force resulting from the pressure of the pawl 2 on a tooth 1*b* of the date disk 1 with respect to the guide roller 20*a*. The arrow $F_2$ has also been used to show the moment of the force resulting from the correction rocker 8 pressed by the spring 9 against the concave curve 1*a of the correction cam 1***a* with respect to this same guide roller 20*a*. It can be seen that this moment of the force $F_2$, the lever arm of which is appreciably greater than that of the moment of the force $F_1$ develops a higher couple in the opposite direction to that of the moment of the force $F_1$, which means that it is able to cause the date disk 1 to rock with respect to the roller 20*a* as illustrated in chain line in FIG. 6.

A fourth roller 20*d* situated a certain distance away from the edge of the date disk 1 acts as a stop to limit the rocking of the date disk 1. This rocking allows the set of teeth 1*b* of the date disk 1 to move away from the finger 3 after the jump from the 30th to the 31st during the passage from the 30th to the 1st, so that this two-step jump of the date disk then becomes instantaneous while at the same time maintaining the locking intended to prevent a jump by two dates in other cases.

It may further be seen from FIG. 5 that the spring 9 pressing the rocker against the correction cam 1*a* and the annual cam 18 is a two-arm spring, one arm of which presses on the correction rocker 8, while the other presses against a pull-out time and date setting lever 21 of the winding and setting mechanism. Normally, this pull-out setting lever 21 is in the position illustrated in chain line in FIG. 5, in which position the winding stem 22 occupies an axial position pushed toward the center of the clock movement. When this pull-out setting lever is pulled out to bring it into the position drawn in continuous line in FIG. 5, corresponding to the time and date setting position, it can be seen that the arm of the spring 9 which presses on the pull-out setting lever moves through a substantial angle with respect to the arm of this same spring 9 which presses against the correction rocker 8, appreciably reducing the pressure of the spring on this correction rocker 8, making the operations of correcting the date and setting the time easier and improving dependability during this operation by reducing the pressure of the rocker 8 on the correction cam 1*a* of the date disk 1.

As seen from reading the foregoing description, the annual calendar mechanism according to the present invention is extremely simple because it comprises only a correction cam 1*a*, a correction rocker 8, an annual cam 18 which may or may not cancel the action of the correction cam 1*a* and a driving star 11 for this annual cam 18. This simplicity guarantees the reliability of the mechanism, all the components consisting of toothed components with the exception of the correction rocker 8 needed to effect the additional step at the end of months of under 31 days and which renders this correction instantaneous.

This mechanism occupies very little space either in the plane or in terms of height. Although an annual date mechanism associated with an instantaneous jump mechanism has been described, this invention can obviously be applied to other date mechanisms with semi-instantaneous jump or with trailing date change. Likewise, as can be seen, this invention also applies to a calendar indicating the date, the day and the month, and to a date alone or to a calendar indicating the date and the day.

What is claimed is:

1. An annual date mechanism for a clock movement comprising a date indicating runner with thirty-one positions engaged once a day with a drive runner in kinematic connection with the geartrain of said clock movement, an annual cam, the contour of which is shaped to distinguish the thirty-one-day months from the other months, means for driving this annual cam by one revolution per year and a correction mechanism connected to, said annual cam to advance said indicating runner by one additional position at the end of each month of less than 31 days, wherein the correction mechanism comprises a correction cam in kinematic connection with said date indicating runner, a correction rocker engaged, on the one hand, with said correction cam and, on the other hand, with said annual cam, and a spring for pressing said correction rocker against said cams, said correction cam comprising a, portion for arming said spring, followed by a portion sized to cause said date runner to move by one step between the "31" and the "1" under the pressure of said spring.

2. The date mechanism as claimed in claim 1, in which said correction cam is of annular shape and is concentric and secured to said date runner and bears a projection intended to engage, on each revolution of said date runner, with a runner for the driving of said annual cam for driving said runner by one step.

3. The date mechanism as claimed in claim 1, in which said annual cam is circular and divided into twelve equal sectors having two different respective diameters, a larger diameter for the 31-day months than for the other months, thus forming five recessed parts of smaller diameter corresponding to the months of under 31 days, which recessed parts can be entered by a linger secured to said correction rocker under the pressure of said spring when said correlation cam frees said correction rocker to the pressure of said spring, this annual cam being concentric with a driving wheel, a spring and relative displacement angular limiting means connecting said annual cam to said driving wheel.

4. The date mechanism as claimed in claim 1, in which said spring has two arms, one pressing against said correction rocker and the other against a pull-out time and date setting lever of the winding and setting mechanism of said clock movement, so that when said pull-out setting lever is moved into the time-setting or date-setting position, it simultaneously relaxes said spring.

5. The date mechanism as claimed in claim 1, in which said driving runner is connected to a set of teeth of said date indicating runner by an instantaneous jump mechanism comprising a driving finger secured to an instantaneous jump cam concentric with said driving runner and having, with respect to the latter, a degree of angular freedom equal to one step of said driving finger, so that immediately after said instantaneous jump, said driving finger remains engaged with said set of teeth of the date indicating runner and is held in this set of teeth by said driving runner for a sufficient length of time to prevent any additional movement of said date indicating runner.

6. The date mechanism as claimed in claim 5, in which said date indicating runner has an annular shape and is mounted to pivot via two rollers against which the edge of said date indicating runner is held by the pressure exerted by a positioning jumper of this indicating runner, the moment of the force with respect to one of said rollers exerted on this indicating runner by said jumper being appreciably lower than and developing a couple in the opposite direction to the moment of the force developed by said correction rocker when it is in engagement with said portion sized to cause said date runner to move by one step so as to move said date runner with respect to said roller about which said couple exerted by said correlation rocker is exerted, said driving finger being situated between this roller and the end of said rocker in engagement with said portion sized to cause said date runner to move by one step so as to disengage the set of teeth of said date indicating runner from said driving finger when this runner is driven by said correction rocker.

* * * * *